US005228348A

United States Patent [19]

Frigiere

[11] Patent Number: 5,228,348

[45] Date of Patent: Jul. 20, 1993

[54] STRAIN GAUGE JOYSTICK

[75] Inventor: Denis Frigiere, Chabeuil, France

[73] Assignee: Sextant Avionique, Cedex, France

[21] Appl. No.: 669,724

[22] Filed: Mar. 14, 1991

[30] Foreign Application Priority Data

Mar. 15, 1990 [FR] France ..... 90 03574

[51] Int. Cl.[5] ..... G01L 5/22

[52] U.S. Cl. ..... 73/862.05; 73/862.044

[58] Field of Search ..... 73/862.05, 862.627, 73/862.044; 244/236; 74/471 XY; 273/148 B

[56] References Cited

U.S. PATENT DOCUMENTS

| | | | |
|---|---|---|---|
| 2,895,086 | 7/1959 | Petit | 244/236 |
| 3,447,766 | 6/1969 | Palfreyman | 73/862.05 X |
| 3,832,895 | 9/1974 | Strandh | 73/862.05 |
| 4,217,569 | 8/1980 | Nejedly et al. | 73/862.05 X |
| 4,348,634 | 9/1982 | David et al. | 323/353 |
| 4,437,351 | 3/1984 | McGrann et al. | 73/862.05 |
| 4,558,609 | 12/1985 | Kim | 74/471 XY |
| 4,758,692 | 7/1988 | Roeser et al. | 200/6 A |
| 4,795,952 | 1/1989 | Brandsetter | 73/862.05 X |

FOREIGN PATENT DOCUMENTS 0151479 4/1985 European Pat. Off. .

2211280 6/1989 United Kingdom .

OTHER PUBLICATIONS

Patent Abstracts of Japan JP-A-60-126721, Shimazu et al., vol. 9, No. 289, 1985.

Metalloberflache publication by Suchentrunk, entitled "Galvonoformung von Hochfrequenzbauteilen" vol. 36; No. 7, 1982.

*Primary Examiner*—Michael T. Razavi

*Assistant Examiner*—Elizabeth L. Shopbell

*Attorney, Agent, or Firm*—Lowe, Price, LeBlanc & Becker

[57] ABSTRACT

A strain gauge joystick with an enabling push-button comprises a support part (1). A thin-wall cylindric tube (5) is rigidly fixed, at a first extremity (4), to the supporting part (1). Strain gauges (8*a*-8*d*) are fixed on the tube near its first extremity (4). A hand lever (6) connected to the other extremity (7) of the tube transmits to the tube the radial force (9) exerted by a user, and also constitutes a push-button movable along the longitudinal axis (10) of the tube when activated by the user. A control device (13) accommodated inside the tube can be activated by the longitudinal displacement of the hand lever.

7 Claims, 1 Drawing Sheet

STRAIN GAUGE JOYSTICK

BACKGROUND OF THE INVENTION

The present invention generally relates to a strain gauge joystick supplying signals representative of a manipulation force liable to be exerted in any radial direction with respect to the joystick and further including an enabling button.

In various applications, for example in some interactive electronic games, a control joystick, designed to be operated with one hand and liable to be moved in any radial direction, is provided. In some applications, it is further useful to associate to such a joystick a push-button that can be activated at any time, with the same hand, for example for enabling a specific manipulation.

Such a joystick is generally constituted by a supporting part in which is embedded a solid flexible stick comprising at its free end a control lever and bearing four strain gauges circumferentially arranged at regularly spaced points. The four strain gauges are usually bridge-connected and supply electric signals representative of the displacement of the hand lever in a plane perpendicular to the longitudinal axis of the hand lever.

The flexible stick is generally relatively stiff, so that its flection remains low when manipulated at the maximum allowed strength. Generally, one uses a steel stick having a few millimeters in diameter and a few centimeters in length, thus forming a joystick having the shape of a small-diameter and small-length lever that can be held within one hand.

It is known to associate to such joystick a unit constituted by an enabling push-button and a switch activated by this push-button. The push-button is then arranged at the end of the stick and the switch is positioned at the side of the stick. Therefore, the joystick does not have a symmetrical shape with respect to the longitudinal axis of the flexible stick, because of the lateral position of the switch. Such an arrangement causes manufacturing problems due to the fact the push-button eccentrically activates the switch and causes assembly difficulties because the laterally arranged switch increases the overall size of the unit.

It is generally provided to accommodate the unit formed by the flexible stick and the switch in a fixed cylindric envelope, the flexible stick and the cylindric envelope being coaxially arranged. With this cylindric envelope, the external shape of the joystick is cylindrical, ensuring a physical protection of the switch. The inner diameter of the cylindric envelope has a minimum size equal to twice the size of the switch in the radial direction, not including the diameter of the flexible stick. This arrangement involves that either the cylindric envelope has a relatively large diameter which impairs its mounting, or the switch, and the possible intermediate parts transmitting the motion of the push-button to the switch, must be highly miniaturized, which causes extra costs or a decreased reliability of the joystick.

For example, the joystick can be associated to a plane control handle. The handle has to be highly reliable and have a small size, despite the numerous control devices provided thereon.

An object of the invention is to provide a strain gauge joystick equipped with an enabling push-button, in the form of a small-size cylindric lever with a reduced diameter and length.

Another object of the invention is to provide a joystick with minimum complexity and higher reliability.

SUMMARY OF THE INVENTION

To attain these objects and others, the strain gauge joystick comprises a supporting part; a thin-wall cylindric tube rigidly fixed, at a first extremity, to the supporting part; at least two strain gauges fixed on the tube close to the first extremity; a hand lever connected to the other extremity of the tube, this hand lever transmitting to the tube the radial force applied by the user, and also constituting a push-button movable along the longitudinal axis of the tube when activated by the user; and a control device placed inside the tube and activated by the longitudinal displacement of the hand lever.

According to an embodiment of the invention, the stain gauge joystick comprises four strain gauges circumferentially arranged and spaced equidistantly on the external surface of the tube.

According to an implementation of the invention, the tube of the joystick is formed by electrochemical deposit of a first metal material on a cylindric mandrel made of a second material, then by selective etching of the cylindric mandrel, to leave in place only the part constituted by the first metal material which then forms the tube.

According to an embodiment of the invention, the wall thickness of the joystick tube is about 20 μm.

According to an embodiment of the invention, the supporting part of the joystick has a cylindric portion comprising a longitudinal bore, the cylindric portion longitudinally extending inside the tube, and the control device being accommodated inside the bore.

According to an embodiment of the invention, the cylindric portion of the supporting part extends inside the tube up to the vicinity of its other end and comprises an external cylindric surface having a diameter slightly smaller than the inner surface diameter of the tube, so as to limit the tube flection when the joystick is operated.

According to an embodiment of the invention, the hand lever comprises a cylindric part passing through a tip fixed at the end of the tube, the cylindric part being capable of longitudinally sliding inside the tip when the hand lever is used as a push-button, the cylindric part activating the control device under the effect of its longitudinal displacement, by means of a driving mechanism arranged inside the bore of the cylindric portion of the supporting part and being capable of longitudinally sliding inside the bore.

BRIEF DESCRIPTION OF THE DRAWINGS

The foregoing and other objects, features and advantages of the invention will be apparent from the following detailed description of a preferred embodiment as illustrated in the accompanying figures wherein.

DETAILED DESCRIPTION OF THE INVENTION

Figure 1:
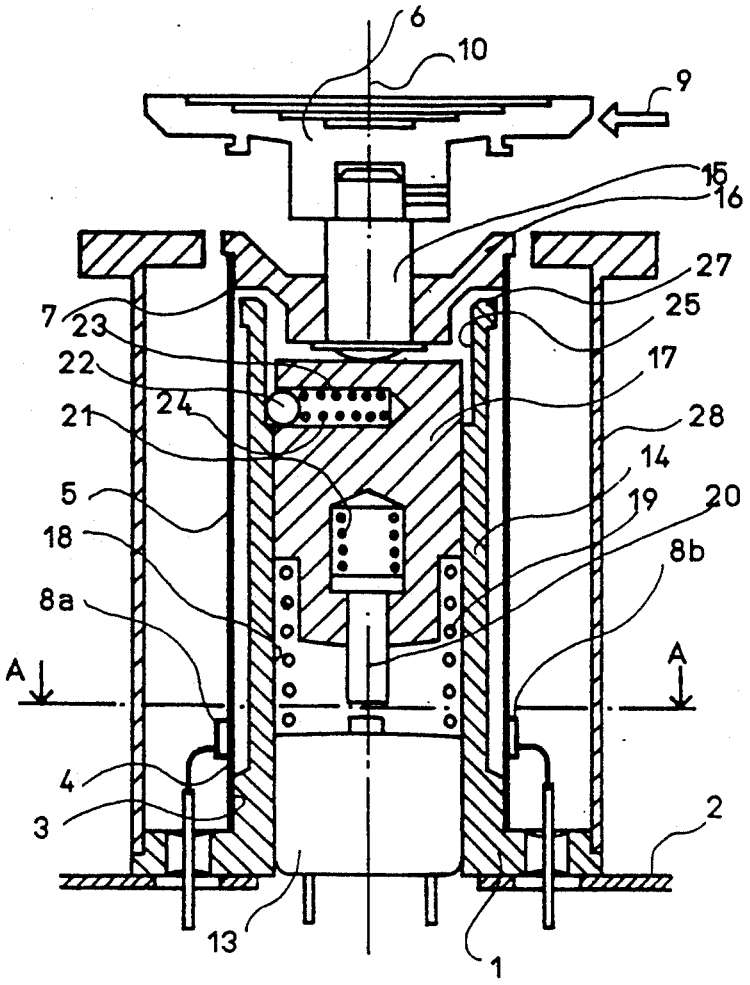
FIG. 1 is a longitudinal section view of a joystick according to the invention.
Figure 2:
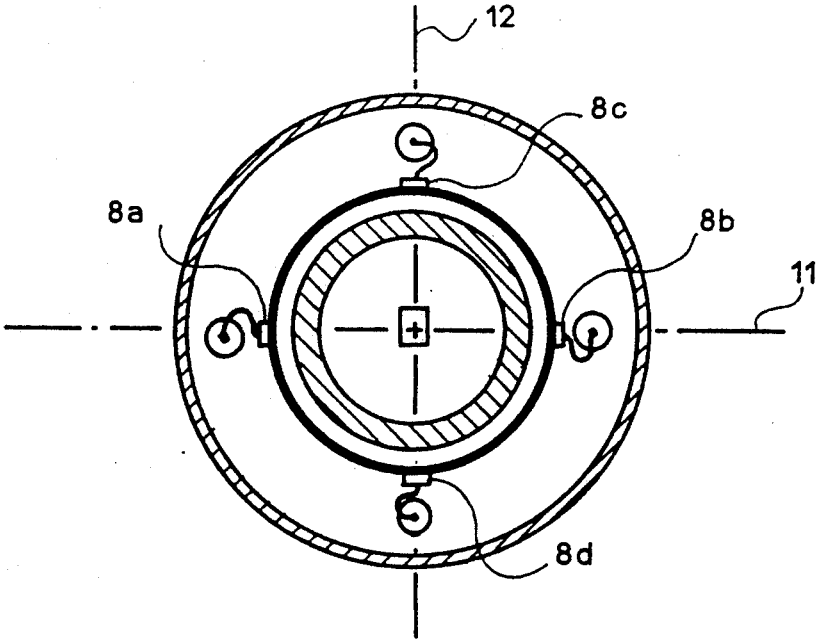
FIG. 2 is a transversal section view according to line A—A of FIG. 1.

FIG. 1 is a section view of a joystick according to the invention. The joystick comprises a supporting part 1 rigidly fixed on the frame of any ordinary apparatus 2. The supporting part 1 comprises a cylindric surface forming a base 3 on which is engaged the lower end 4 of a thin-wall cylindric tube 5. Tube 5 is thus permanently fixed on the supporting part 1, for example by bonding or welding. A hand lever 6 is fixed at the other end 7 of tube 5. Four strain gauges 8a–8d are fixed to the external surface of tube 5, near its lower end 4, and are regularly periphically spaced, as shown in FIG. 2. Under the effect of a radial force (shown by arrow 9), that is, a force perpendicular to the longitudinal axis 10 of tube 5, the tube bends and causes compression or extension of strain gauges 8a–8d. Strain gauges 8a –8d are connected to a conventional measurement device (not shown) for determining the magnitude and direction in a radial plane of the flection of tube 5, this flection corresponding to the radial force exerted by the user on hand lever 6.

The hand lever 6 also forms a push-button that can be longitudinally moved, along axis 10, independently of its radial displacements. Therefore, the user can exert on hand lever 6 simultaneously a driving action by a force with a determined radial intensity and direction, and an independent enabling action by pressing hand lever 6 downwards.

According to the invention, the whole mechanism activated by the enabling push-button formed by the hand lever 6 is arranged inside the thin-wall tube 5. Thus, it is possible to place inside tube 5 an electric switch 13 or any other control device providing a binary signal in response to the action of the push-button, as well as guiding and return mechanical parts of the push-button. Tube 5 must not be hindered when radially moving. For this reason, switch 13 and the above mentioned mechanical parts are in fact arranged and fixed inside a hollow cylindric portion 14 of the supporting part 1, this cylindric portion 14 being arranged inside tube 5.

Hand lever 6 is coupled to a cylindric part 15, downwardly oriented, passing through a tip 16 rigidly fixed to tube 5 at its upper end 7. Part 15 can freely slide longitudinally with respect to tip 16.

When hand lever 6 is used as a push-button, the user exerts thereon a downward force along axis 10. The lower end of part 15 then downwardly pushes a cylindric part 17 arranged and longitudinally guided inside a cylindric bore 18 of the cylindric portion 14 of supporting part 1. Switch 13 is permanently fixed in the lower portion of the bore 18. Inside bore 18, in the interval between switch 13 and the cylindric part 17, is placed a first compression spring 19 urging part 17 upwardly.

Part 17 controls switch 13 through a control part 20 liable to slide longitudinally with respect to part 17 and is downwardly urged by means of a second compression spring 21. This intermediate control part 20 limits the force exerted on switch 13 when the user presses the hand lever 6, in order to avoid damaging switch 13 if a too high pressure is applied by the user.

The cylindric part 17 also includes a ball 22 provided in a radially arranged hole 23 and urged outwardly by a spring 24; ball 22 thus rests on an inner cylindric wall 25 arranged in the cylindric portion 14 and has a larger diameter than that of bore 18. Therefore, ball 22 resists against a downward displacement of part 17 and hence of hand lever 6; thus, the user has to overcome a determined force to be able to operate the switch 13, which allows him to be sure his control has been achieved.

The whole mechanism arranged inside part 14 substantially occupies the entire inner volume of the thin-wall tube 5. This mechanism is mainly constituted by cylindric parts, centered on the longitudinal axis 10, the displacements of which are made coaxially with respect to the direction of the pushing force exerted by the user on hand lever 6. Such a device is very easy to manufacture, has a satisfactory reliability and a small-size structure. It is thus possible to make a joystick, the size of which is relatively small, without overminiaturizing its constituents, particularly the parts activating switch 13 and switch 13 itself.

Using a thin-wall tube 5 has the further advantage that, for operating conditions equivalent to those of a solid cylindric stick, the thin-wall tube 5 has a larger diameter, which permits fixing more easily the four strain gauges 8a–8d on the tube, with a more accurate positioning. Indeed, it is difficult to ensure a very good bonding and positioning of a gauge when the latter is fixed on a very small-size part, as with solid-stick joysticks.

The cylindric portion 14 of the supporting part 1 ensures positioning and guiding function of the driving mechanism of switch 13, as above explained, but further ensures the function of limiting the radial displacement of the upper end 7 of tube 5. For this purpose, the upper end of the cylindric portion 14 has an external cylindric surface 27, the diameter of which is slightly lower than the diameter of the inner wall of tube 5, half the difference in diameter between these two parts determining the maximum flection that can be withstood by the upper end 7 of tube 5 when the user exerts radial driving force.

It is also possible to provide an external cylindric envelope 28 rigidly fixed on the supporting part 1 for protecting tube 5 against any accidental damage.

Tube 5 must have a relatively high flexibility, despite its relatively high diameter which is, for example, about 10 mm, while being made of a material having a relatively low elastic modulus. Hence, the wall of tube 5 must be extremely thin and have, for example, a thickness of about 20 μm.

Tube 5 can be made by using a cylindric mandrel of a first material, for example aluminum, by electrochemically depositing on the external wall of this mandrel another material, for example nickel, then by etching the mandrel in order to fully eliminate the material constituting this mandrel, for finally maintaining the nickel part only, which then forms tube 5.

Thus, a nickel tube having a 10 mm diameter, a 30 mm length and a 20 μm wall thickness, allows the use of strain gauges under conditions analogous to those obtained by conventionally using a flexible solid steel stick with a 3 mm diameter and a 30 mm length.

A thin-wall tube differs from a flexible solid stick in that, with an equivalent quadratic moment, the tube mass is lower than that of the solid stick. As a result of this physical characteristic, the eigen frequency of a joystick with a thin-wall tube is substantially higher than that of a joystick with a flexible solid stick. It has been noted that a joystick according to the invention had an eigen frequency of about 10 KHZ whereas an analogous joystick, but with a solid stick, had an eigen frequency of about 1 KHZ. In practice, numerous devices or equipments cause vibrations within a 1 KHZ frequency range. As a result, the joystick according to the invention is less sensitive to vibrations of the equipment on which it is fixed. Moreover, it is all the more easy to dampen vibrations liable to occur in a joystick as those vibrations have a higher frequency.

I claim:

1. A strain gauge joystick comprising:

a supporting part;

a thin-wall cylindric tube rigidly fixed, at a first extremity, to said supporting part;

at least two strain gauges fixed on the tube near said first extremity;

a hand lever connected to a second extremity of the tube, said hand lever rotatable around a longitudinal axis of said tube to activate said strain gauges and movable inside the tube along the longitudinal axis of said tube; and a control device accommodated inside the tube and activated by the longitudinal movement of said hand lever;

wherein said hand lever comprises a cylindric part passing through a tip fixed to said second extremity of tube, said cylindric part longitudinally sliding in said tip when said hand lever is used as a push-button, the longitudinal displacement of said cylindric part activating the control device by means of a driving mechanism arranged inside said bore of said cylindric portion of said supporting part and longitudinally sliding inside said bore.

2. A strain gauge joystick according to claim 1, comprising four strain gauges circumferentially arranged and equidistantly spaced on the external surface of said tube.

3. A strain gauge joystick according to claim 1, wherein the wall thickness of the tube is 20 μm.

4. A strain gauge joystick according to claim 1, wherein said supporting part comprises a cylindric portion having a longitudinal bore, said cylindric portion longitudinally extending inside said tube, and said control device being accommodated inside said bore.

5. A strain gauge joystick according to claim 4, wherein said cylindric portion of the supporting part has an external cylindric surface and has a diameter slightly smaller than the inner diameter of the tube, so as to limit the tube flection when said joystick is activated.

6. A strain gauge joystick according to claim 1, comprising a protective external cylindric envelope surrounding said tube, without contracting the tube when it is bent, said protective envelope being fixed by one of its extremities to said supporting part.

7. A strain gauge joystick comprising:

a supporting part;

a thin-wall cylindric tube rigidly fixed, at a first extremity, to said supporting part;

at least two strain gauges fixed on the tube near said first extremity;

a hand lever connected to a second extremity of the tube, said hand lever rotatable around a longitudinal axis of said tube to activate said strain gauges and movable inside the tube along the longitudinal axis of said tube; and a control device accommodated inside the tube and activated by the longitudinal movement of said hand lever;

wherein said supporting part comprises a cylindric portion longitudinally extending inside said tube and having a longitudinal bore accommodating said control device, and said cylindric portion has an external cylindric surface and a diameter slightly smaller than the inner diameter of the tube, so as to limit the tube flection when said joystick is activated.

* * * * *